United States Patent [19]

Grosholz

[11] 4,361,137

[45] Nov. 30, 1982

[54] INCUBATOR HAVING WARM AIR CURTAIN ACROSS ACCESS OPENING

[75] Inventor: James R. Grosholz, Solebury, Pa.

[73] Assignee: Air-Shields, Inc., Hatboro, Pa.

[21] Appl. No.: 225,261

[22] Filed: Jan. 15, 1981

Related U.S. Application Data

[63] Continuation-in-part of Ser. No. 112,008, Jan. 14, 1980, abandoned.

[51] Int. Cl.[3] ..... A61G 11/00

[52] U.S. Cl. ..... 128/1 B; 98/36

[58] Field of Search ..... 128/1 B, 205.26; 312/209, 236; 98/36

[56] References Cited

U.S. PATENT DOCUMENTS

| | | | |
|---|---|---|---|
| 3,335,713 | 8/1967 | Grosholz et al. | 128/1 B |
| 3,387,600 | 6/1968 | Terzian | 98/36 X |
| 3,511,162 | 5/1970 | Truhan | 98/36 |
| 3,782,362 | 1/1974 | Puzio | 128/1 B |
| 3,821,947 | 7/1974 | Schossow | 128/1 B |

*Primary Examiner*—Henry J. Recla

*Attorney, Agent, or Firm*—Weiser, Stapler & Spivak

[57] ABSTRACT

An incubator arranged for developing a warm air curtain (30) across the opening created when the access door (22) of the incubator is opened.

19 Claims, 9 Drawing Figures

INCUBATOR HAVING WARM AIR CURTAIN ACROSS ACCESS OPENING

DESCRIPTION

This application is a continuation-in-part of application Ser. No. 112,008 filed Jan. 14, 1980 now abandoned.

TECHNICAL FIELD

The present invention relates, in general, to incubators and, in particular, to an infant incubator arranged to reduce the effect of opening an access door in the hood of the incubator while an infant is to be isolated from outside influences.

BACKGROUND ART

An infant incubator is a medical unit which provides a controlled environment for a premature, or otherwise delicate or sick infant. The incubator isolates the infant from the outside atmosphere which might be the source of infections or which might be inadequate to aid the infant in overcoming his difficulity.

Many infant incubators are provided with means for gaining access to the infant to enable giving aid and attention to the infant while he remains within the incubator. Typically, such means may include armholes or access ports in one or more side walls of the hood of the incubator through which those attending to the infant may slip their hands and arms to reach the infant. In certain situations, in the care of the more critically ill infant, it is desirable to provide for more complete access to the infant than is possible by the use of an armhole type of access port. This may be accomplished by providing an access door in the hood. Ordinarily the opening of an access door will not produce significant physiological effects on the infant if the door remains open for a relatively short period of time. However, for certain operative procedures which require longer periods of access to the infant, the environment within the hood may be altered because of the time the access door is held open.

DISCLOSURE OF INVENTION

Accordingly, it is an object of the present invention to provide a new and improved incubator.

It is another object of the present invention to provide an incubator having means for reducing the effect of opening an access door in the hood of the incubator.

It is a further object of the present invention to provide an incubator in which the means for reducing the effect of opening an access door in the hood are simple in construction and add relatively little to the overall cost of the incubator.

An incubator, constructed in accordance with the present invention, includes a base having an infant support and a plurality of air flow passage means for permitting air flow between the space beneath the infant support and the space above the infant support. One of the air flow passage means opens along a lateral edge of the infant support. The incubator also includes a hood surmounting the base and adapted to enclose the infant support and the air flow passage means. A lateral wall of the hood, extending along the lateral edge of the infant support, is provided with an access door which is movable between a closed position and an open position. The incubator further includes a source of conditioned air within the base and below the infant support and means for circulating the conditioned air from below the infant support into the hood and back to below the infant support through the plurality of air flow passage means. Also included in the incubator are means responsive to movements of the access door for closing the air flow passage means extending along the lateral edge of the infant support when the access door is in the closed position and for opening this air flow passage means when the access door is in the open position.

BRIEF DESCRIPTION OF DRAWINGS

Referring to the drawings.

BEST MODE OF CARRYING OUT THE INVENTION

U.S. Pat. No. 3,335,713 is incorporated herein by reference to supplement the disclosure of various components of an incubator, the details of which do not form part of the present invention.

Referring to FIGS. 1A, 1B, 2A and 2B, an incubator, constructed in accordance with the present invention, includes a base 10 having an infant support 12 and a plurality of air flow passage means for permitting air flow between the space beneath the infant support and the space above the infant support. The base contains various units which develop the desired environment within the incubator. Infant support 12 may include a mattress support and mattress upon which an infant may rest. For additional details on an infant support which may be used and the manner in which it may be mounted on the base, reference is made to U.S. Pat. No. 3,335,713.

Figure 2A:
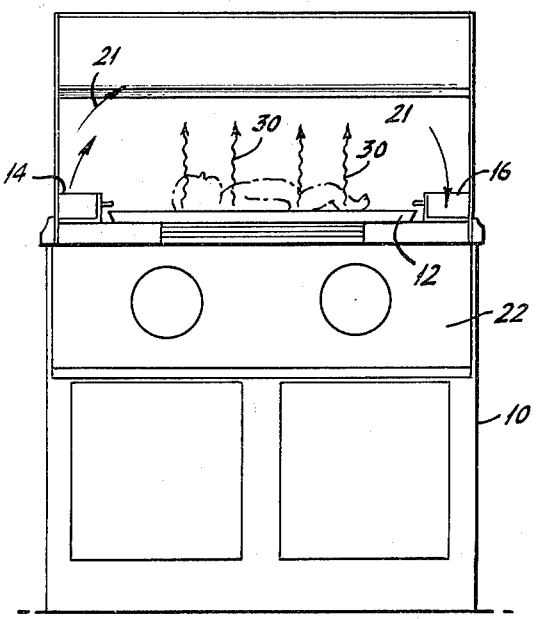
FIGS. 2A and 2B are front and side views similar to FIGS. 1A and 1B with the access door open.
Figure 2B:
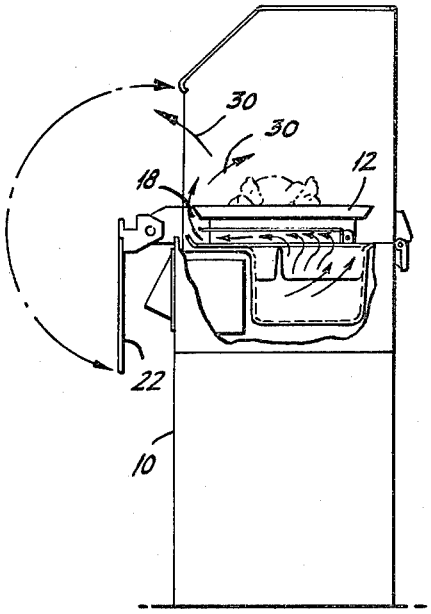

The air flow passage means may include openings 14 and 16 located at the head and foot ends, respectively, of base 10 and infant support 12 and a third opening 18 at the front side of the base and the infant support, shown most clearly in FIG. 2B. Openings 14, 16 and 18 are elongated, narrow openings which extend around three sides of infant support 12. Openings 14, 16, and 18 place the spaces above and below infant support 12 in free communication with each other, whereby air flow between these spaces is permitted. U.S. Pat. No. 3,335,713 provides additional details about openings 14 and 16, while opening 18 is considered in greater detail hereinafter.

The incubator of the invention also includes a hood 20 surmounting base 10 and adapted to enclose an infant resting on the infant support. Hood 20, as shown, is rectangular in cross-section. The front wall portion of hood 20 has an access door 22 movable between a closed position illustrated in FIGS. 1A and 1B and an open position illustrated in FIGS. 2A and 2B. In particular, access door 22 is mounted for pivotal movement about a horizontal axis. The door pivots downward upon opening and upward upon closing. Hood 20 may be mounted on base 10 so that the hood as a whole may be raised by pivotal movement about a hinge running along the top of the rear wall of the base. For additional details about the hood and its mounting, reference again is made to U.S. Pat. No. 3,335,713.

An incubator, constructed in accordance with the present invention, also includes a source of conditioned air within base 10 and below infant support 12. U.S. Pat. No. 3,335,713 shows apparatus which may be used to develop the desired environment within the incubator. Briefly, this apparatus includes an air inlet, filters, heater, oxygen supply, humidifier and other components for producing conditioned air of the proper temperature, oxygen content and humidity.

The FIG. 1 incubator further includes means for circulating the conditioned air from below infant support 12 into hood 20 and back to below the infant support through openings 14 and 16. Such means may include, as shown in U.S. Pat. No. 3,335,713, suitable fans, ducting and the like, whereby conditioned air is forced up into hood 20 through opening 14 and drawn down into base 10 through opening 16 as shown by arrows 21 in FIGS. 1A and 2A. In addition, conditioned air is directed toward opening 18 as shown in FIG. 2B.

Figure 1A:
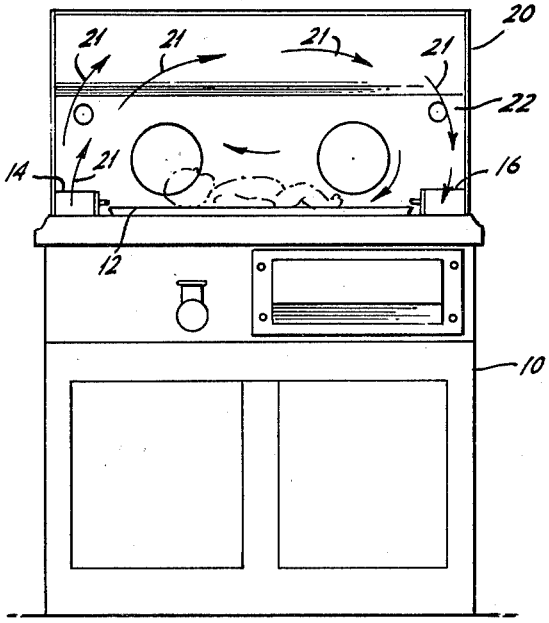
FIGS 1A and 1B are front and side views, respectively, of a preferred embodiment of an incubator constructed in accordance with the present invention with the access door closed.
Figure 1B:
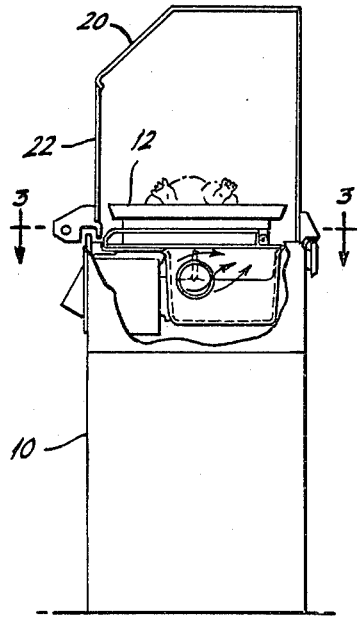
Figure 3:
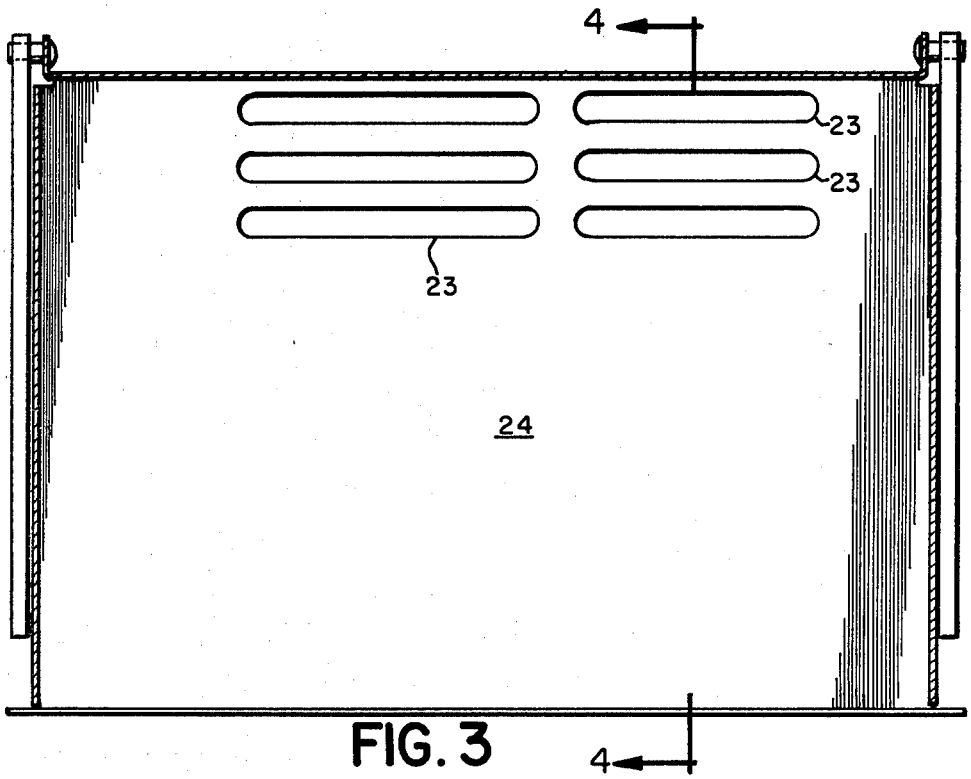
FIG. 3 is a sectional view taken along line 3—3 of FIG. 1B.
Figure 4:
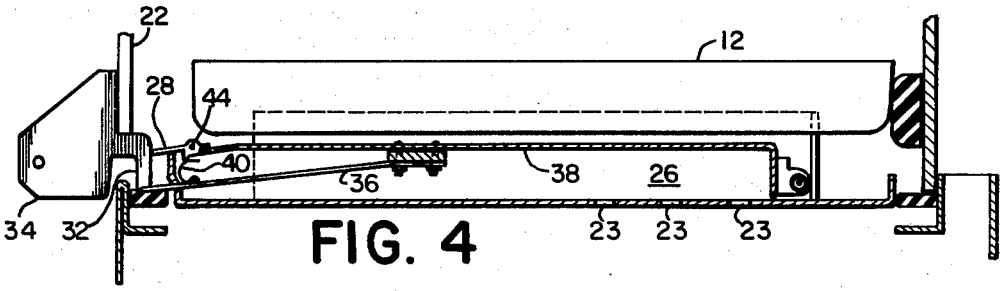
FIG. 4 is a vertical sectional view of an incubator constructed in accordance with the present invention.
Figure 5:
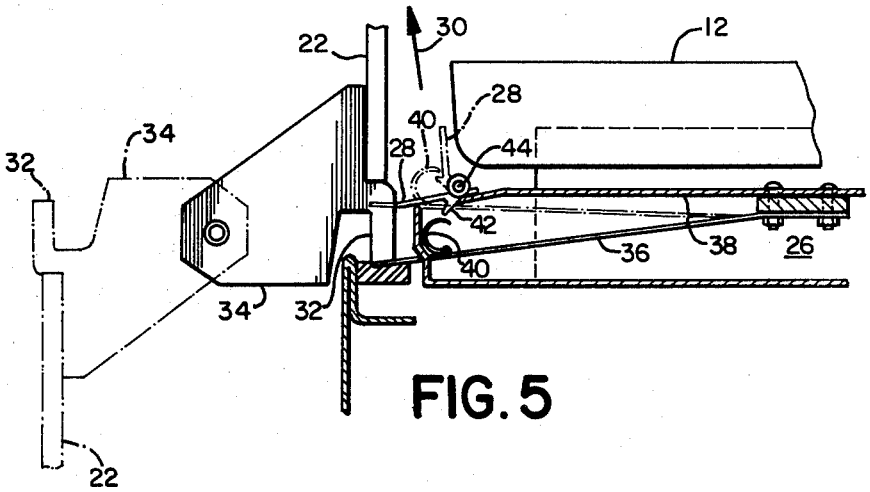
FIG. 5 is an enlargement of a portion of FIG. 4.

An incubator, constructed in accordance with the present invention, further includes means responsive to movements of access door 22 for sealing opening 18 when the door is in the closed position shown in FIGS. 1A and 1B and for uncovering opening 18 when the door is in the open position shown in FIGS. 2A and 2B. FIGS. 3, 4 and 5 show in detail the manner in which conditioned air is delivered to opening 18 and the means which effect the sealing and uncovering of this opening. Conditioned air is forced through a plurality of slots 23 in a deck 24 into a chamber 26 beneath infant support 12. Air flow through opening 18 is controlled by a member, in the form of an elongated strip 28, which is movable to selectively uncover and close opening 18 and a linkage mechanism coupling between strip 28 and access door 22. In particular, elongated strip 28, shaped and dimensioned approximately equal to opening 18, extends along the front side of infant support 12 and is pivotally mounted along one of its longitudinal edges on a longitudinal edge of opening 18. So long as strip 28 is in the position shown in FIG. 4 and shown in solid lines in FIG. 5, opening 18 at the output of chamber 26 is sealed and the conditioned air in chamber 26 is blocked from passing through opening 18. When strip 28 moves to the position shown in dashed lines in FIG. 5, opening 18 is uncovered and the conditioned air moves from chamber 26 through opening 18 as shown by arrows 30 in FIGS. 2A, 2B and 5. At the same time, conditioned air continues to be circulated between the base and the hood through openings 14 and 16 as indicated in FIG. 2A.

The position of strip 28 is controlled by a mechanism which is coupled between the strip and access door 22 and is actuated by the access door. In particular, when access door 22 is in the closed position, a bracket 32 on a door hinge 34, to which door 22 is secured, engages a spring member 36 to move the spring member downwardly to maintain the spring member in the position shown in FIG. 4 and shown in solid lines in FIG. 5. Spring member 36 is secured at its opposite end to the underside 38 of the infant support. Spring member 36 carries a hook 40 which engages a hook 42 on strip 28. So long as spring member 36 is held in the position shown in FIG. 4, strip 28 is in position to seal opening 18.

When access door 22 is opened and door hinge 34 moves to the position shown in dashed lines in FIG. 5, bracket 32 no longer engages spring member 36, thereby permitting the spring member to move to the position shown in dashed lines in FIG. 5. This movement causes hook 40 on spring member 36 to engage the underside of strip 28 and pivot the strip, about a hinge 44, to the position shown in dashed lines in FIG. 5. This permits conditioned air to move from chamber 26 through opening 18 to form a curtain of conditioned air across the door opening. The disposition of strip 28 enhances the air flow to form this curtain. Some of the conditioned air moving upward through opening 18 flows out of the incubator as shown in FIG. 2B, while the remainder stays in the incubator and flows into the main stream being circulated upward through opening 14 and downward through opening 16.

When access door 22 is moved to the closed position, bracket 32 on door hinge 34 engages spring member 36 to return the spring member to the position shown in FIG. 4. As spring member 36 moves downwardly, hook 40 is drawn downwardly. Hook 40, in turn, draws hook 42 downwardly to move strip 28 toward the position at which opening 18 is sealed. At a suitable point in the movement of strip 28, hooks 40 and 42 become disengaged and strip 28 moves into the sealing position from the effect of gravity.

Figure 6:
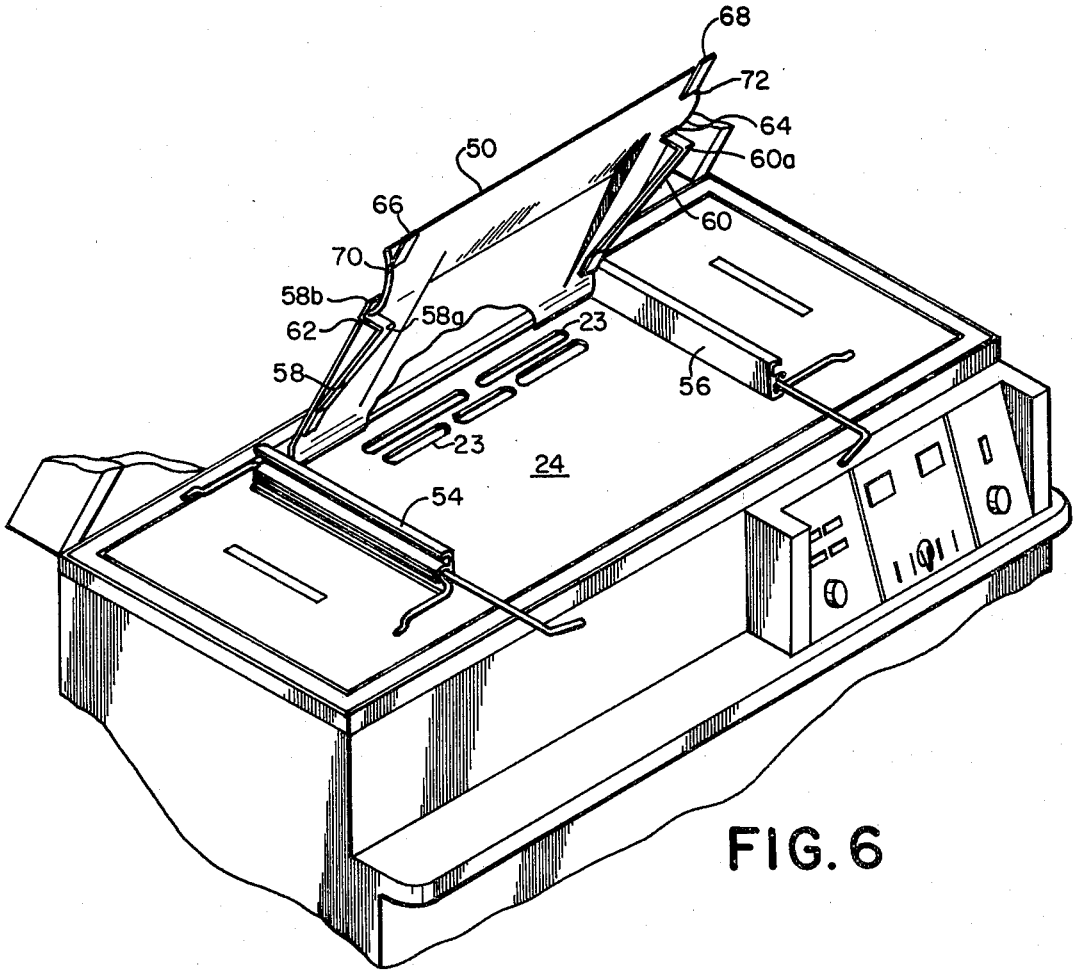
FIG. 6 is a perspective view of a second preferred embodiment of an incubator constructed in accordance with the present invention.
Figure 7:
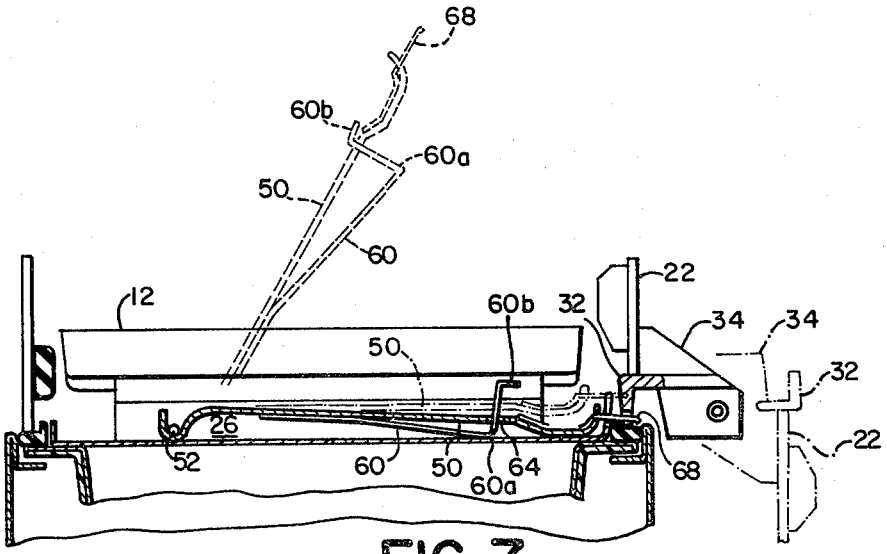
FIG. 7 is a vertical section of the FIG. 6 incubator.

FIGS. 6 and 7 show a second preferred embodiment of the present invention. Components in FIGS. 6 and 7 which are similar to components in FIGS. 1–5 have been given the same reference numerals. The difference between the second embodiment of the invention and the first resides in the manner in which the curtain of conditioned air is formed when access door 22 is opened.

In the embodiment of the invention shown in FIGS. 6 and 7, the air flow passage which extends along the front edge of infant support 12 is formed by a baffle 50 which is mounted for pivotal movement about a pivot rod 52. Baffle 50 is shown in a raised position in FIG. 6 and in dashed lines in the raised position in FIG. 7. With the baffle in this position deck 24 may be cleaned or the baffle may be removed from the incubator by slipping the hooked rear edge of the baffle from under pivot rod 52. The pivot rod is secured to deck 24 by a pair of flanges 54 and 56 which, in turn, are fastened to the deck by suitable means. Flanges 54 and 56, baffle 50 and deck 24 define chamber 26 below infant support 12.

Secured along both side edges of baffle 50 are springs 58 and 60. Each of these springs is fastened to the bottom surface of the baffle and is bent to extend through respective slots 62 and 64 at the side edges of the baffle. The arrangement of baffle 50 and springs 58 and 60 is such that the baffle tends to spring upwardly to the position shown in dot-dash lines in FIG. 7 while corners **58*a* and 60*a* of the springs maintain contact with deck 24. Bent tabs 58*b* and 60*b* of the springs limit the upward movement of the baffle caused by the springs. With baffle 50 in the upper position shown by the dot-dash lines in FIG. 7, the air flow passage extending along the front edge of infant support 12 is open and conditioned air passing upward through slots 23 to chamber 26 is delivered to this open air flow passage to form an air curtain. This condition exists when access door 22** is open.

When access door 22 is closed, bracket 32 on door hinge 34, to which door 22 is secured, engages a pair of strips 66 and 68 which are fastened to the upper surface of baffle 50 at the edges of the baffle and extend through slots 70 and 72, respectively, at the edges of the baffle. The closing movement of access door 22 causes baffle 50 to move downwardly against the action of springs 58 and 60. With access door 22 closed, baffle 50 is in the position shown by the solid lines in FIG. 7 and the air flow passage extending along the front edge of infant support is closed.

While in the foregoing there have been described preferred embodiments of the invention, it should be understood to those skilled in the art that various modifications and changes can be made without departing from the true spirit and scope of the invention as recited in the claims.

I claim:

1. An incubator comprising:

a base having an infant support and three air flow passage means for permitting air flow between the space beneath said infant support and the space above said infant support, the first and second air flow passage means opening at opposite ends of said infant support and the third air flow passage means opening at the front side of said infant support;

a hood surmounting said base and adapted to enclose said infant support and said air flow passage means, the front wall of said hood having an access door movable between a closed position and an open position;

a source of conditioned air within said base and below said infant support;

means for circulating said conditioned air from below said infant support into said hood through said first and third air flow passage means and back to below said infant support through said second air flow passage means;

and sealing means responsive to movements of said door for sealing said third air flow passage means when said door is in said closed position and for uncovering said third air flow passage means when said door is in said open position.

2. An incubator according to claim 1 wherein said first, second and third air flow passage means include elongated openings in said base extending along said opposite ends and said front side of said infant support.

3. An incubator according to claim 1 wherein said third air flow passage means include a chamber beneath said infant support which communicates with said source of conditioned air.

4. An incubator according to claim 2 wherein said sealing means include:

(1) an elongated strip shaped and dimensioned approximately equal to said elongated opening extending along said front side of said infant support and pivotally mounted along a longitudinal edge of said strip on a longitudinal edge of said opening extending along said front side; and (2) control means coupled to said elongated strip and engaged by said access door when said door is in said closed position for maintaining said elongated strip in a position of sealing said elongated opening extending along said front side of said infant support when engaged by said access door and for urging said elongated strip to uncover said elongated opening extending along said front side of said infant support when said control means are disengaged from said access door.

5. An incubator according to claim 4 wherein said third air flow passage means includes a chamber beneath said infant support having an input communicating with said source of conditioned air and an output communicating with said opening at said front side of said infant support.

6. An incubator comprising: a base having an infant support and defining a space therein below said infant support;

a hood surmounting said base and adapted to enclose an infant resting on said support and defining a space above said infant support, the walls of said hood being spaced from said infant support and forming a plurality of air flow passages therebetween, said hood having an access door and one of said air flow passages extending along said door;

a source of conditioned air within said base and below said infant support;

means for circulating said conditioned air between said spaces beneath and above said infant support through said air flow passages;

and air flow control means responsive to movements of said access door for blocking said air flow passage extending along said door when said door is closed and for opening said air flow passage extending along said door when said door is open.

7. An incubator according to claim 6 wherein said access door is mounted for pivotal movement about a horizontal axis.

8. An incubator according to claim 7 wherein said access door pivots downward upon opening and upward upon closing.

9. An incubator according to claim 6 wherein said hood is rectangular in cross-section and two of said air flow passages are located at opposite ends of said hood.

10. An incubator according to claim 9 wherein conditioned air is directed upward through one of said air flow passages at an end of said hood and through said air flow passage extending along said access door and drawn downward through the other of said air flow passage at an end of said hood.

11. An incubator according to claim 10 wherein said air flow passages are elongated openings.

12. An incubator according to claim 11 wherein said base includes a chamber beneath said infant support having an input communicating with said source of conditioned air and an output communicating with said air flow passage extending along said access door.

13. An incubator according to claim 12 wherein said air flow control means include:

(1) a member pivotally movable to selectively uncover and close said air flow passage extending along said access door; and (2) a mechanism coupled between said member and said access door and responsive to movements of said door to uncover said air flow passage extending along said door when said door is opened and to close said air flow passage extending along said door when said door is closed.

14. An incubator comprising:

a base having an infant support and a plurality of air flow passage means for permitting air flow between the space beneath said infant support and the space above said infant support, one of said air flow passage means opening along a lateral edge of said infant support;

a hood surmounting said base and adapted to enclose said infant support and said air flow passage means, a lateral wall of said hood extending along said lateral edge of said infant support and having an access door movable between a closed position and an open position;

a source of conditioned air within said base and below said infant support;

means for circulating said conditioned air from below said infant support into said hood and back to below said infant support through said plurality of air flow passage means;

and means responsive to movements of said access door for closing said one air flow passage means when said access door is in said closed position and for opening said one air flow passage means when said access door is in said open position.

15. An incubator according to claim 14 having three air flow passage means, said one air flow passage means passing conditioned air from below said infant support into said hood, a second air flow passage means opening at one end of said infant support and passing conditioned air from below said infant support into said hood, and a third air flow passage means opening at a second end of said infant support and passing conditioned air from said hood back to below said infant support.

16. An incubator according to claim 14 wherein said one air flow passage means include a chamber beneath said infant support which communicates with said source of conditioned air.

17. An incubator according to claim 16 wherein said one air flow passage means includes a baffle which defines an upper surface of said chamber.

18. An incubator according to claim 17 wherein said baffle is mounted on said base along the rear edge of said baffle.

19. An incubator according to claim 18 wherein said means for closing and opening said one air flow passage means include:

(1) spring means for urging said baffle upward to open said one air flow passage means; and (2) a mechanism moveable with said access door for engaging said baffle to move said baffle downward against said spring means to close said one air flow passage means and for releasing said baffle to permit said baffle to move upward to open said one air flow passage means.

* * * * *

US004361137B1

REEXAMINATION CERTIFICATE (3132th)

United States Patent [19] [11] B1 4,361,137

Grosholz [45] Certificate Issued Feb. 18, 1997

[54] INCUBATOR HAVING WARM AIR CURTAIN ACROSS ACCESS OPENING

[75] Inventor: James R. Grosholz, Solebury, Pa.

[73] Assignee: Air-Shields, Inc., Hatboro, Pa.

Reexamination Request:
No. 90/003,339, Feb. 23, 1994

Reexamination Certificate for:

| | |
|---|---|
| Patent No.: | **4,361,137** |
| Issued: | **Nov. 30, 1982** |
| Appl. No.: | **225,261** |
| Filed: | **Jan. 15, 1981** |

Related U.S. Application Data

[63] Continuation-in-part of Ser. No. 112,008, Jan. 14, 1980, abandoned.

[51] Int. Cl.[6] ..... A61G 11/00

[52] U.S. Cl. ..... 600/22; 119/35

[58] Field of Search ..... 600/21–22; 119/35, 119/39–40; 312/209, 236

[56] References Cited

U.S. PATENT DOCUMENTS

| | | |
|---|---|---|
| 3,335,713 | 8/1967 | Grosholz et al. . |
| 3,618,734 | 11/1971 | Khan . |
| 3,782,362 | 1/1974 | Puzio . |
| 4,936,824 | 6/1990 | Koch et al. . |

OTHER PUBLICATIONS

Constantinides et al., "A Non–Electrical Incubator for Developing Countries," *Medical and Biological Engineering*, Jan., 1973 pp. 65–68.

Vickers Medical, Model 79 Servo Incubator Mk4 brochure, copyright Vickers PLC 1976.

Musch et al., "An Air Curtain Incubator for Use in an Intensive–Care Nursery," *The Journal of Pediatrics*, Dec., 1971 pp. 1025–1030.

*Primary Examiner*—Angela D. Sykes

[57] ABSTRACT

An incubator arranged for developing a warm air curtain (30) across the opening created when the access door (22) of the incubator is opened.

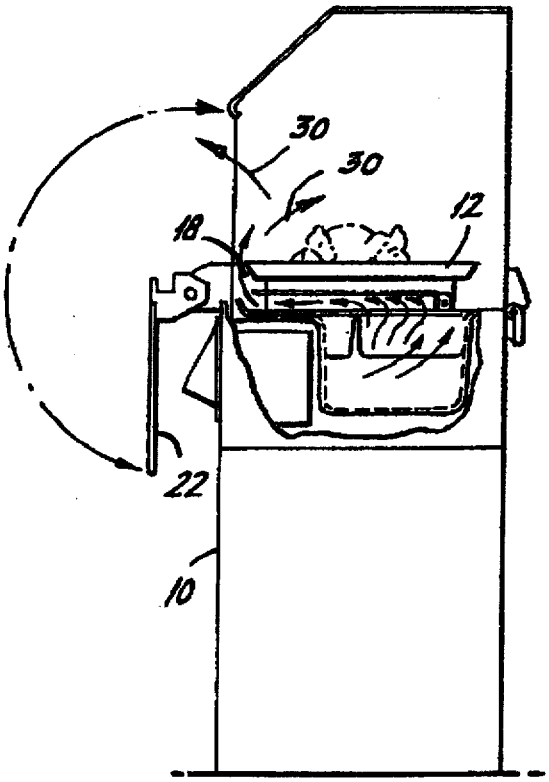

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–19 is confirmed.

* * * * *